US012465819B2

(12) United States Patent
Butcher et al.

(10) Patent No.: US 12,465,819 B2
(45) Date of Patent: Nov. 11, 2025

(54) LIGHT-UP BOUNCING BALL

(71) Applicant: Duncan Toys Company, LLC., Baraboo, WI (US)

(72) Inventors: Stephen W. Butcher, Bristol, RI (US); Robert Driscoll, South Deerfield, MA (US)

(73) Assignee: Duncan Toys Company, LLC, Baraboo, WI (US)

( * ) Notice: Subject to any disclaimer, the term of this patent is extended or adjusted under 35 U.S.C. 154(b) by 59 days.

(21) Appl. No.: 18/513,872

(22) Filed: Nov. 20, 2023

(65) Prior Publication Data

US 2025/0161762 A1 May 22, 2025

(51) Int. Cl.
*A63B 43/06* (2006.01)
*A63B 67/06* (2006.01)

(52) U.S. Cl.
CPC ..... *A63B 43/06* (2013.01); *A63B 67/06* (2013.01); *A63B 2220/40* (2013.01); *A63B 2220/53* (2013.01)

(58) Field of Classification Search
CPC ..... A63B 43/06; A63B 67/06; A63B 2220/40; A63B 2220/53
See application file for complete search history.

(56) References Cited

U.S. PATENT DOCUMENTS 3,580,575 A * 5/1971 Speeth ..... A63B 43/06 482/84
4,776,589 A * 10/1988 Yang ..... A63B 43/06 473/570
5,054,778 A * 10/1991 Maleyko ..... H05B 45/00 446/485
5,066,011 A * 11/1991 Dykstra ..... A63B 43/06 446/485
5,236,383 A * 8/1993 Connelly ..... A63B 43/06 473/576
5,445,375 A * 8/1995 Sweeny ..... A63B 43/00 473/570
5,725,445 A * 3/1998 Kennedy ..... A63B 43/007 473/570
6,464,602 B1 * 10/2002 Rottger ..... A63B 43/00 463/9
10,213,647 B2 * 2/2019 Balakrishnan ..... H01Q 1/44
11,559,725 B1 * 1/2023 Ayal ..... A63B 43/06
2001/0049311 A1 * 12/2001 Lewis ..... A63B 43/06 473/570
2005/0261083 A1 * 11/2005 Liao ..... A63B 24/0021 473/570
2007/0021244 A1 * 1/2007 Ko ..... A63B 41/00 473/570
2007/0281811 A1 * 12/2007 Wang ..... A63B 43/06 473/570
2012/0040785 A1 * 2/2012 De Sort ..... A63B 43/06 473/570

(Continued)

*Primary Examiner* — Steven B Wong
(74) *Attorney, Agent, or Firm* — McDonald Hopkins LLC

(57) ABSTRACT

A system includes ball and a plurality of wristbands. The ball includes a shell, a sensor, a processor, a memory, and a plurality of LEDs. The sensor is configured to detect interaction with the ball. The processor is configured to control a color of light emitted by the plurality of LEDs according to the detected interaction and a plurality of rules stored in the memory. The plurality of wristbands correspond to the colors of light emitted by the plurality of LEDs.

14 Claims, 6 Drawing Sheets

(56) References Cited

U.S. PATENT DOCUMENTS

| | | | | |
|---|---|---|---|---|
| 2012/0244969 | A1* | 9/2012 | Binder | G08B 21/182 473/570 |
| 2014/0194232 | A1* | 7/2014 | Krysiak | A63B 41/085 473/570 |
| 2018/0043218 | A1* | 2/2018 | Hu | A63B 41/00 |

* cited by examiner

LIGHT-UP BOUNCING BALL

BACKGROUND

Balls may provide entertainment and/or serve as training aids for children, adults, and pets alike, individually and in groups. As training aids, they may be used to improve hand-eye coordination, improve focus, improve motor skills and the like. As entertainment, they may be used to play various games by hitting, shooting, passing, kicking, rolling, and bouncing the balls. In particular, bouncing balls are designed to retain relatively large amounts of kinetic energy when bounced off a hard surface. Light-up balls can provide entertainment through colorful lighting patterns.

BRIEF SUMMARY

According to one example of the present disclosure, a system comprises: a ball and a plurality of wristbands. The ball includes a shell through which light can pass, a sensor, a processor, a memory, and a plurality of LEDs. The memory is configured to store rules for operations of the processor. The plurality of LEDs are configured to emit light having a plurality of different colors. Each of the plurality of wristbands are a different color, each color corresponding to one of the plurality of colors emitted from the plurality of LEDs. The processor is further configured to detect an interaction of the ball with an external environment based on an output of the sensor and control a color of light emitted by the plurality of LEDs based on the detected interaction of the ball and the rules stored in the memory.

In various embodiments of the above example, the shell is an elastomeric material; the sensor is a gyrometer, accelerometer, or force sensor; the processor is configured to: detect an initial input caused by bouncing or tapping the ball based on an output of the sensor, after detecting the initial input, begin a first countdown period and cause the plurality of LEDs to emit light of a first color in a first pattern, detect a second input caused by bouncing or tapping the ball based on the output of the sensor prior to the first countdown period expiring, and after detecting the second input, begin a second countdown period and cause the plurality of LEDs to emit light of a second color in a second pattern, wherein the first color and the second color is different, or the first pattern or the second pattern is different, and wherein the second countdown period is longer than the first countdown period; the processor is configured to cause the plurality of LEDs to stop emitting light when no input is detected within the first countdown period; the processor is configured to: detect an initial input caused by bouncing or tapping the ball based on an output of the sensor, after detecting the initial input, cause the plurality of LEDs to emit light of a first color for one cycle of a first pattern, after detecting the initial input, begin a first countdown period and a second countdown period, until expiration of the first countdown period or the second countdown period: detect a subsequent input caused by bouncing or tapping the ball based on the output of the sensor, and after detecting the subsequent input, cause the plurality of LEDs to emit light of a subsequent color, and after detecting the subsequent input, reset the first countdown period, wherein the second countdown period is longer than the first countdown period; the processor is configured to: detect an initial input caused by bouncing or tapping the ball based on an output of the sensor, after detecting the initial input, cause the plurality of LEDs to emit light of a first color for one cycle of a first pattern, after detecting the initial input, begin a first countdown period, detect a second input caused by bouncing or tapping the ball based on the output of the sensor prior to the first countdown period expiring, and after detecting the second input: cause the plurality of LEDs to emit light of a second color for a second countdown period, and after the second countdown period, cause the plurality of LEDs to emit light of a third color for a third countdown period, wherein at least one of the first color, the second color, and the third color is different than the other colors; the processor is configured to: detect an initial input caused by bouncing or tapping the ball based on an output of the sensor, after detecting the initial input, cause the plurality of LEDs to emit light of a first color for one cycle of a first pattern, detect at least one subsequent input caused by bouncing or tapping the ball based on the output of the sensor, and after detecting each subsequent input, cause the plurality of LEDs to randomly emit light of a second color or a third color, wherein the second color and the third color are different than each other and different than the first color; and/or the second color is red and the third color is green.

DETAILED DESCRIPTION OF THE DRAWING

Considering the above, the present disclosure relates to a system including a bouncing ball or a similar bouncing toy having a circuit board located therein, and a plurality of colored wristbands. The circuit board includes a plurality of LEDs, sensors, and timers, which together detect movement of and player interaction with the bouncing ball, and facilitate LED light changes based on various pre-defined rules.

Figure 1:
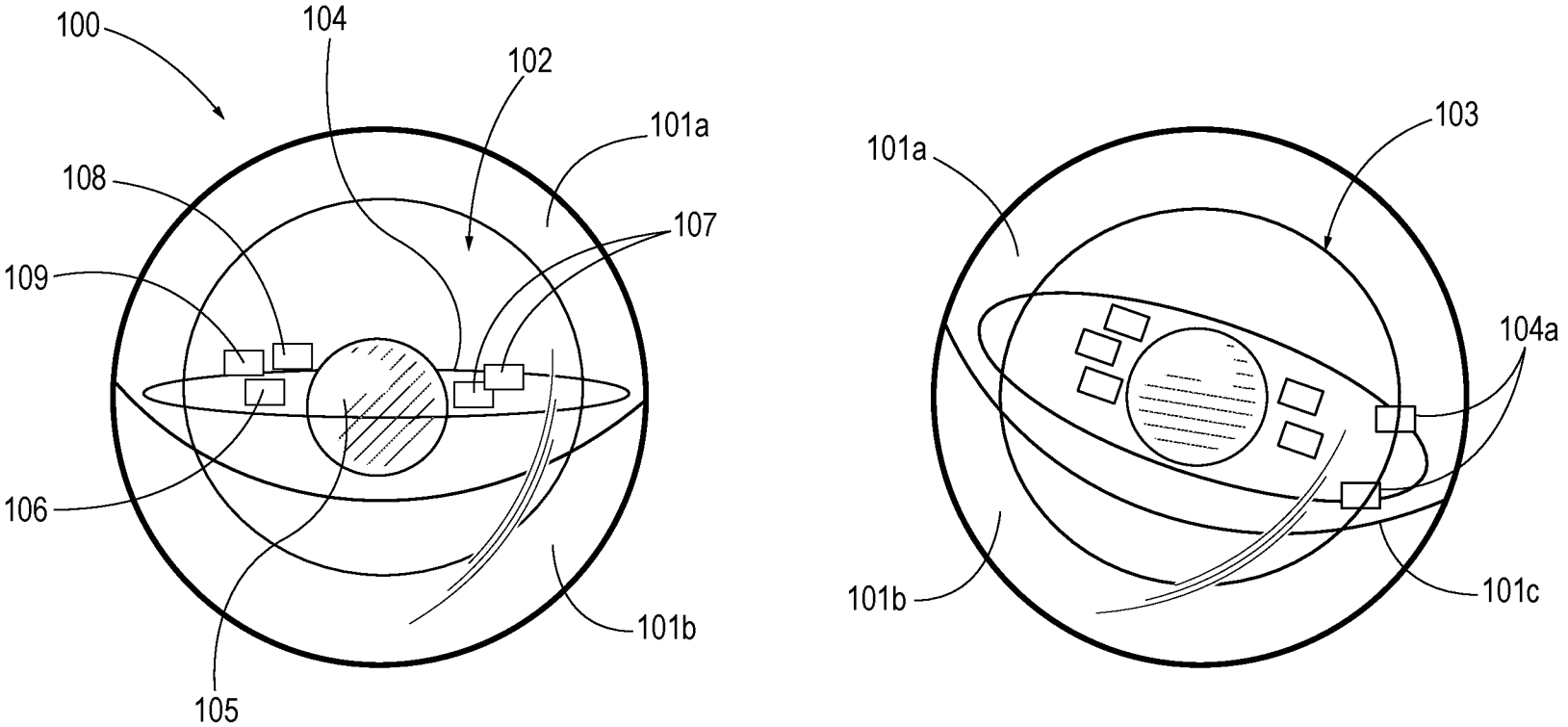
FIG. 1 illustrates front and perspective views of an example bouncing ball.

According to the example of FIG. 1, a ball 100 is formed from two half-shells including a top half-shell 101*a* and a bottom half-shell 101*b*, and an inner ball 103. Each half-shell 101*a*, 101*b* and the inner ball 103 are formed of a material that allows light to pass through (e.g., translucent, semi-transparent, semi-opaque, or opaque) resin or like polymer (e.g., a rubber material) having elastomeric properties. Depending on the embodiment, more opaque materials may provide greater durability and/or strength for the ball 100. The inner ball 103 is located within or formed inside of the two half-shells 101*a*, 101*b*. An inner cavity 102 is located within the inner ball 103. The two half-shells 101*a*, 101*b* are joined together at a seam 101*c*. The inner ball 103 is held in place via force (i.e., pressure or friction) applied by the two half-shells 101*a*, 101*b*. The ball 100 may also be formed by a casting process, for example, where an outer shell and inner ball are formed in a single piece around the internal elements.

A sensor 105, a processor 106 (e.g., an integrated circuit and/or discrete circuitry), a plurality of light emitting diodes (LEDs) 107 or like light sources, and a battery 108 are mounted to a circuit board 104. The circuit board 104 is located within the inner cavity 102. A plurality of holding portions 104*a* secure the circuit board 104 in place. The holding portions 104*a* may be, for example, stems, ribs, tabs, or the like. Alternatively, or in addition to the holding portions 104*a*, the circuit board 104 may be held in place by an inner groove of the seam 101*c*, or as suggested above, the inner ball 103 may be cast around the circuit board 104 so as to encapsulate the board 104. The battery 108 may provide power to the sensor 105, the processor 106, and/or the plurality of LEDs 107. A memory 109 (e.g., read-only memory (ROM), flash memory, random access memory (RAM), or the like) may also be mounted to the circuit board 104 and be configured to store pre-determined rules for the processor 106 to control an output of the plurality of LEDs 107 based on an output signal of the sensor 105.

The sensor 105 may be a gyrometer, accelerometer, force/pressure sensor, positioning sensor (e.g., GPS), motion tracking sensor, timer, time of flight sensor, photoreflective sensor, radar sensor, ultrasonic sensor, magnetometer, Hall effect sensor, BLUETOOTH sensor, RFID sensor, NFC sensor, and/or the like. The sensor 105 is preferably able to detect interaction between a player and the ball 100 and/or interaction between the ball 100 and the external environment. For example, the sensor may detect when a player strikes the ball 100 (e.g., by tapping the ball with their hand or catching the ball) and/or when the ball 100 bounces (e.g., off of the ground or another surface).

The output signal of the sensor 105 may then be supplied to the processor 106, which can analyze the output signal to determine various characteristics of the interaction with the ball 100. For example, a magnitude of the output signal from the sensor 105 may be compared to a threshold value. A bounce or other external force applied to the ball 100 may cause the magnitude of the output signal to exceed the threshold value. By analyzing the output signal of the sensor 105 in this way, the processor 106 may determine, for example, a number of bounces of the ball 100, a speed of the ball 100, a rotational/angular and/or linear velocity and/or acceleration of the ball 100, a distance of movement of the ball 100, time the ball 100 is in a "sleeping" state, and the like. In some embodiments, the sensor 105 may be an array of the same or different sensors, each configured to detect one or more physical parameters.

Still further, the sensor 105 may detect which player has the ball 100 and/or relative proximities of each player based on corresponding body-worn sensors on the players (e.g., a smart watch, BLUETOOTH or RFID wristband, or the like). For example, each player's wristband may contain a unique RFID. By comparing strengths of the signals of each detected RFID, the processor 106 may determine that the player having the RFID with a greatest signal strength is the player currently possessing the ball 100.

Based on the analyzed sensor outputs, the processor 106 is configured to control a color of light output by the plurality of LEDs 107. According to one example, the plurality of LEDs 107 may include separate red, blue, and green LEDs that are, in cooperation with each other, able to output light of any color (e.g., yellow, green, blue, red, and/or white). However, in other examples, LEDs of specific colors may be included in the plurality of LEDs 107. Because the half-shells 101*a*, 101*b* are translucent, the color of light output by the plurality of LEDs 107 is externally visible to a player. In other words, the color of the ball 100 may be changed by controlling the color of light output by the plurality of LEDs 107.

Figure 2:
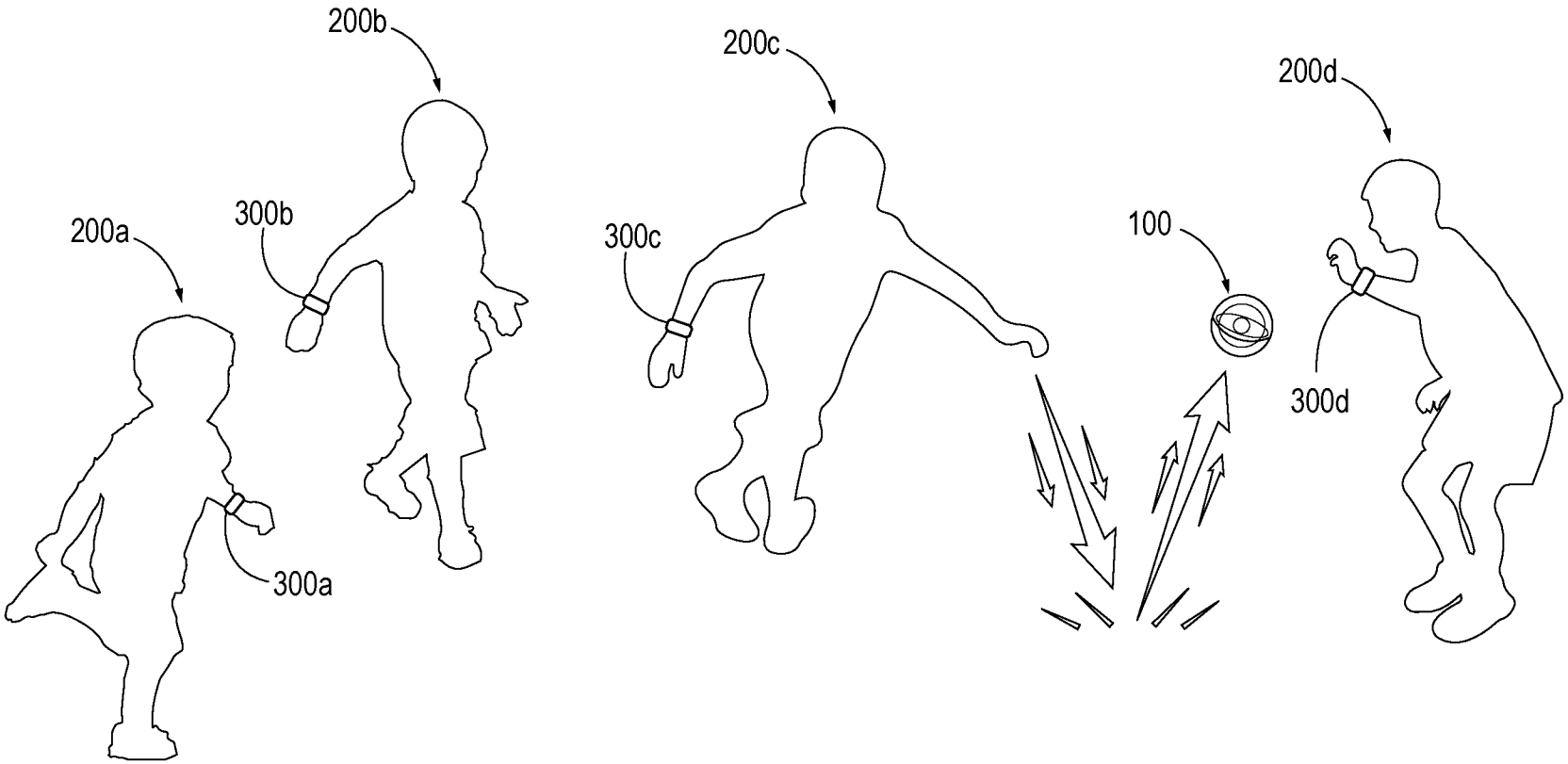
FIG. 2 illustrates an example system of the present disclosure.

Generally, the present disclosure relates to a game system including the above described ball 100 and one or more wristbands worn by each of a plurality of players, the wristbands having colors corresponding to colors or light that may be output by the LEDs 107. For example, as illustrated in FIG. 2, each of a plurality of players 200*a*, 200*b*, 200*c*, 200*d* has a corresponding wristband 300*a*, 300*b*, 300*c*, 300*d* having a different color (one of yellow, green, blue, and red). The ball 100 has LEDs 107 that may output yellow, green, blue, and red light, corresponding to the different colors of wristbands 300*a*, 300*b*, 300*c*, 300*d*. While the following examples relate to four colors and four players 200*a*, 200*b*, 200*c*, 200*d*, it is understood that the number of players is not limiting and the present disclosure also pertains to a greater or fewer number of colors and/or players.

Figure 3:
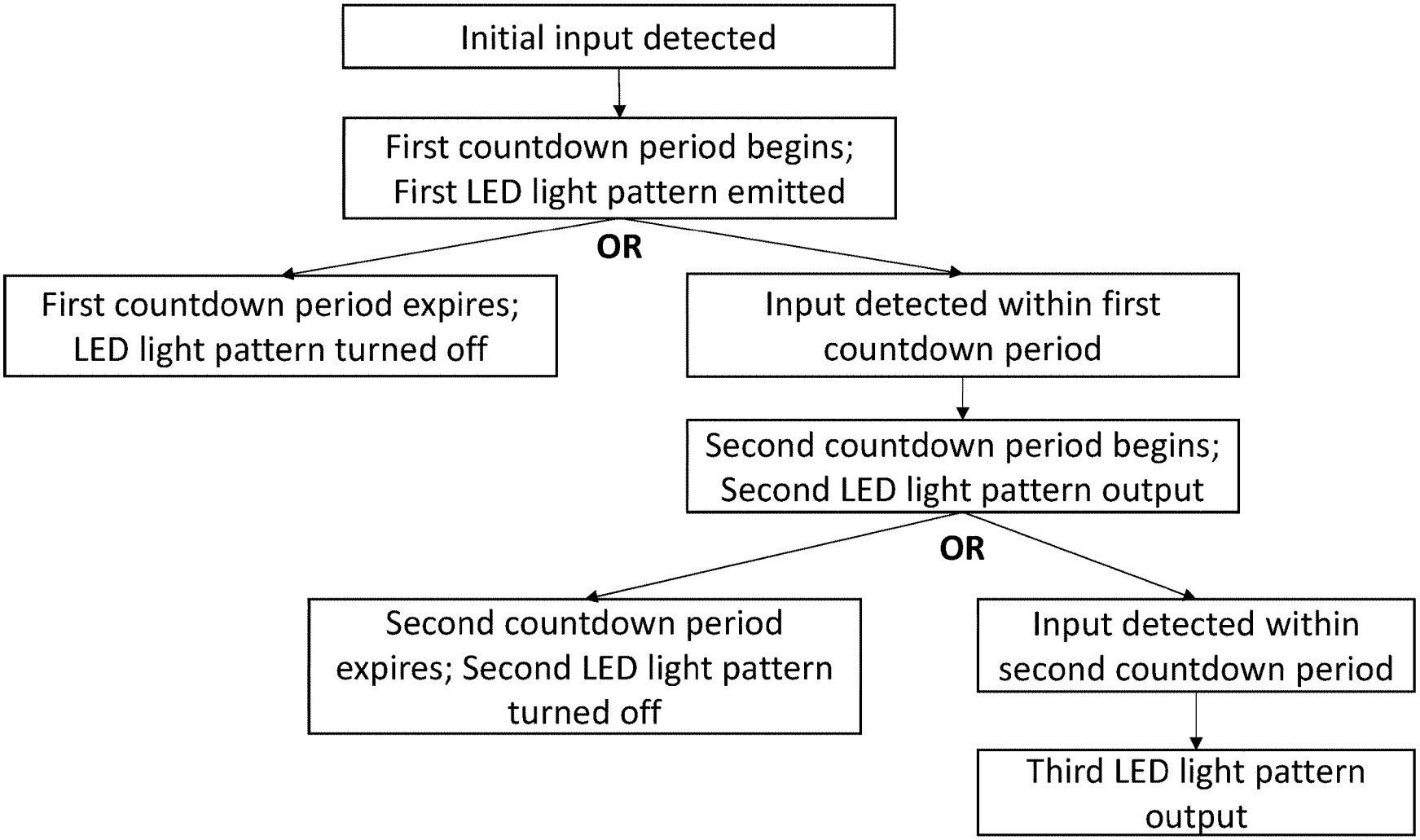
FIG. 3 illustrates an example operation of an example system.

As noted above, the processor 106 is configured to control a color of light output by the plurality of LEDs 107 based on the analyzed output signals of the sensor 105 and pre-defined rules corresponding to a game being played by the players. FIG. 3 illustrates a general example operation of the ball 100 as used during gameplay by the plurality of players 200*a*. 200*b*, 200*c*, 200*d*. As seen therein, the sensor 105 of the ball 100 first detects an input from one of the players 200*a*, 200*b*, 200*c*, 200*d*. The input may be caused by a player bouncing or throwing the ball 100, tapping the ball 100, or otherwise causing an external force on the ball 100. The input triggers a countdown period of a timer of the processor 106 and causes the processor 106 to control the plurality of LEDs 107 to emit a first pattern of light.

If the countdown period ends and no further input is detected by the sensor 105, the processor 106 is configured to cause the plurality of LEDs 107 to stop emitting light. If further input is detected by the sensor 105 within the countdown period, the processor 106 is configured to cause the plurality of LEDs 107 to emit a second pattern of light. The countdown period of the timer is restarted upon detection of the further input by the sensor 105. Again, if the countdown period ends and no further input is detected by the sensor 105, the processor 106 is configured to cause the plurality of LEDs 107 to stop emitting the second pattern of light. And again, if a still further input is detected by the sensor 105 within the countdown period, the processor 106 is configured to cause the plurality of LEDs 107 to emit a third pattern of light. This pattern is repeated until no further input is detected within the countdown period of the timer.

Figure 4:
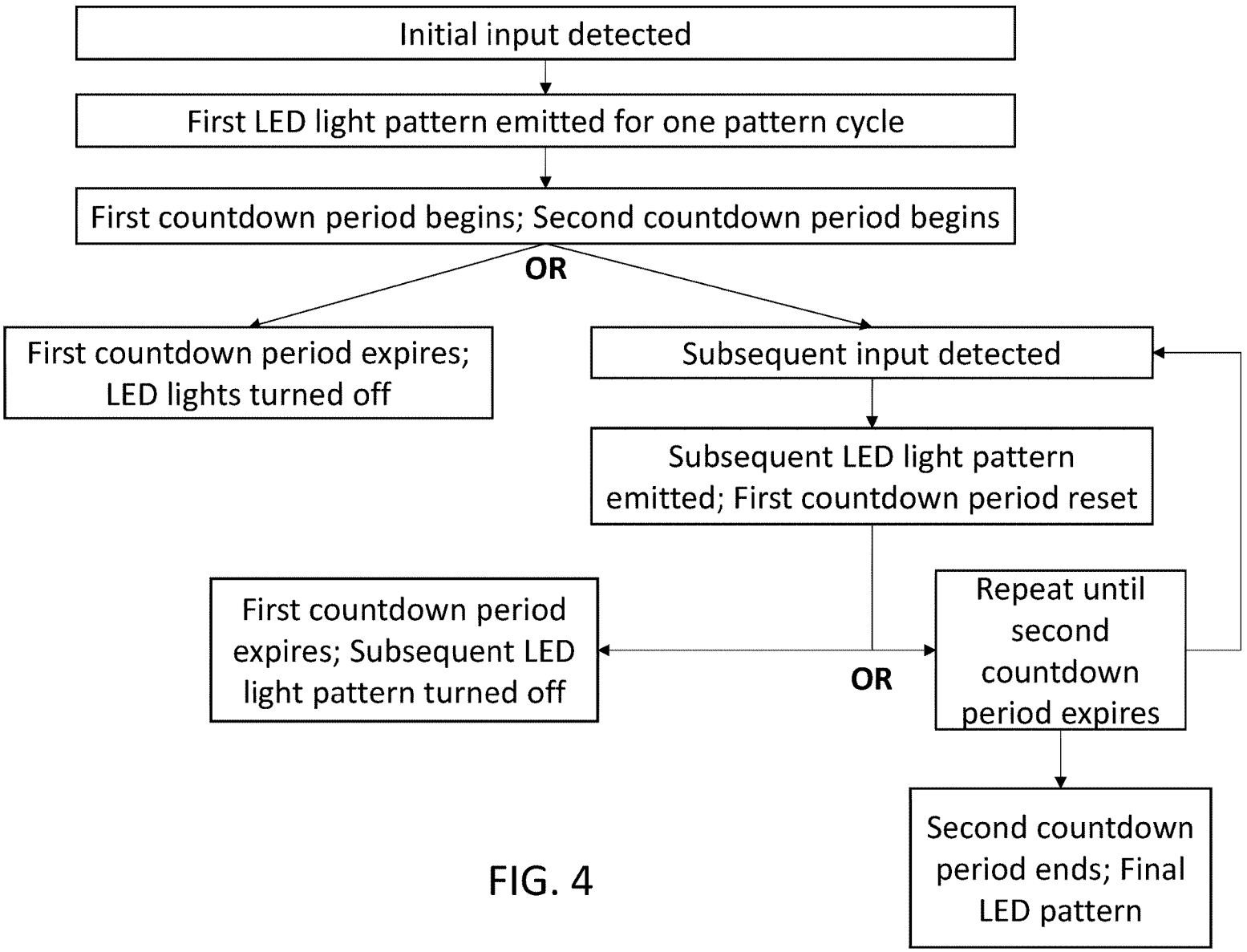
FIG. 4 illustrates a first example operation mode of a system of the present disclosure.
Figure 5:
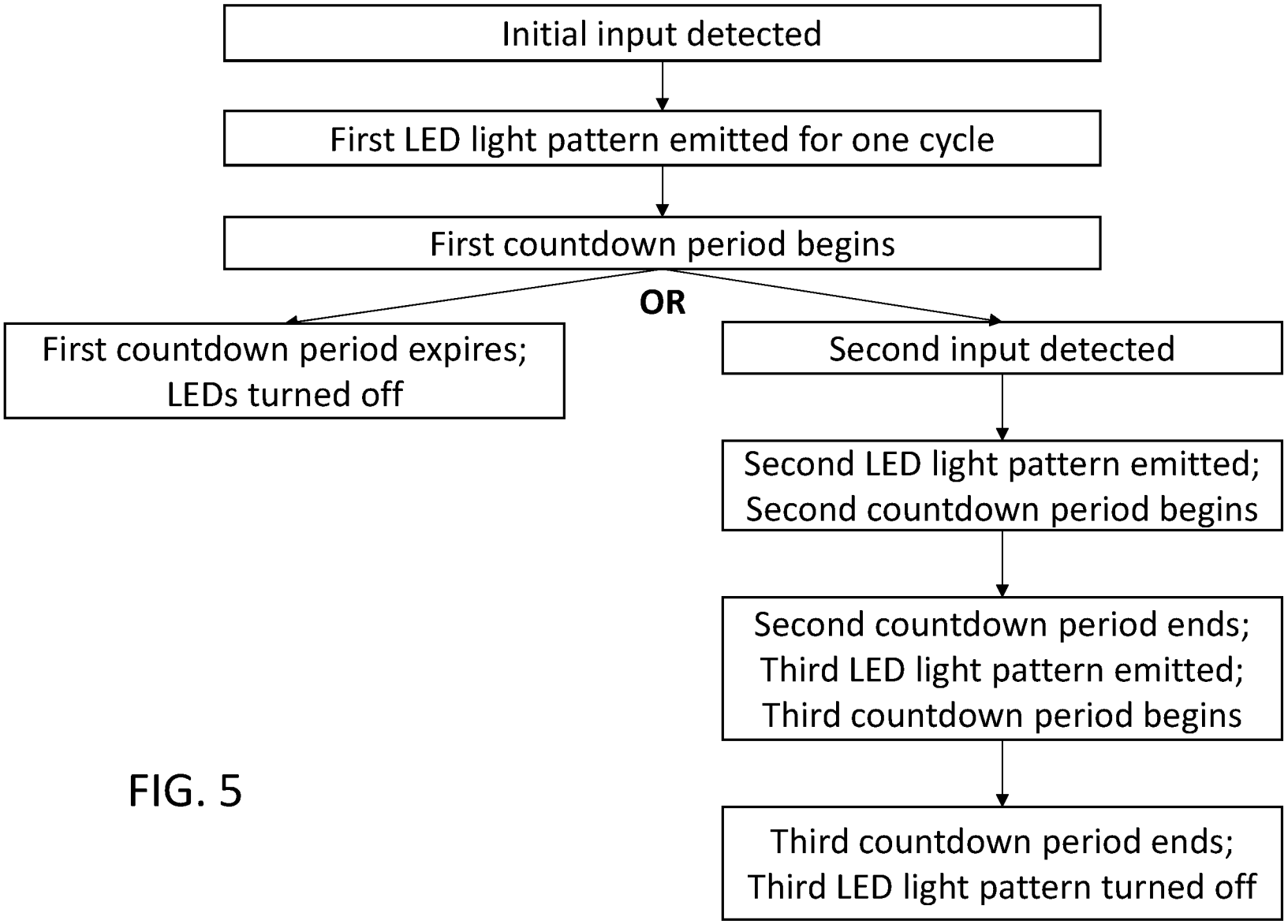
FIG. 5 illustrates a second example operation mode of a system of the present disclosure.
Figure 6:
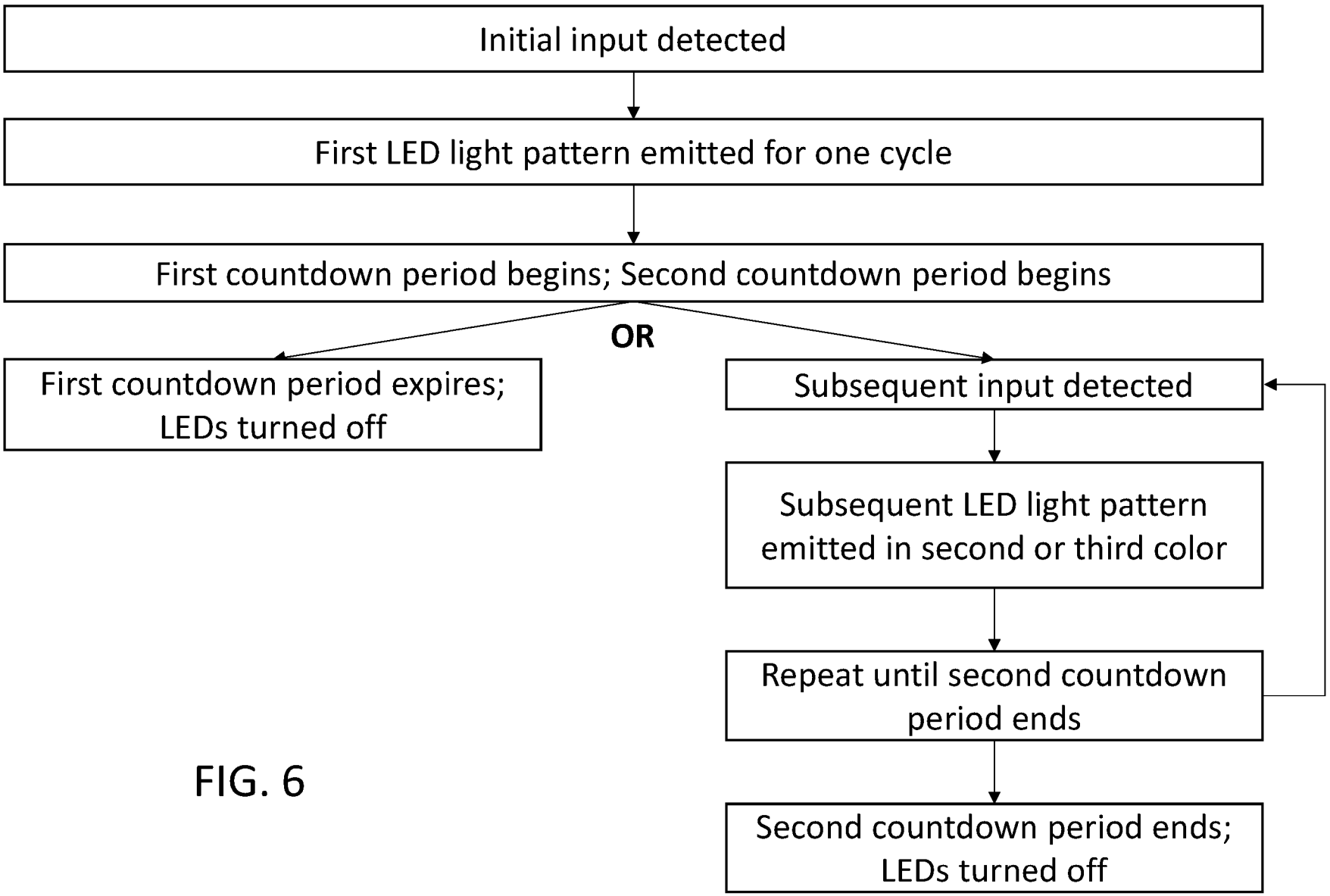
FIG. 6 illustrates a third example operation mode of a system of the present disclosure.

Variations of the process according to FIG. 3 may be executed according to a plurality of operation modes having rules stored in the memory 109. Three example operation modes are illustrated in FIGS. 4-6. Variations of each operation mode may be played in a plurality of styles. As described herein, each operation mode of FIGS. 4-6 may be played according to three game styles. The memory 109 of any given ball 100 may store rules corresponding to any one or more of the operation modes and/or game styles.

First Example Operation Mode

A first operation mode may be conducted as seen in FIG. 4. According to the example of FIG. 4, first the sensor 105 of the ball 100 detects an initial input from one of the players, such as an externally applied force (e.g., a tap or bounce). The initial input triggers the processor 106 to control the plurality of LEDs 107 to emit a first pattern of light in a first color. According to various examples, the first pattern of light may be three short flashes in quick succession followed by a three second pause, three long flashes each separated by one second, a series of flashes every other second for five seconds, a solid light for five or ten seconds, or the like. The time periods associated with each pattern may be of any length, and may be pre-determined or random.

After a first cycle of the first pattern is complete, the processor 106 begins a first countdown period and a second countdown period, the second countdown period being longer than the first countdown period. The first countdown period is a predetermined period of time, while the second countdown period may be a randomized period of time. The first countdown period may be, for example, any multiple of 10 seconds, such as 30 seconds, 60 seconds, or 90 seconds in length. The second countdown period may be, for example, a random period of time generated by the processor 106, or a predetermined period of time (e.g., two minutes, five minutes, or the like).

If the sensor 105 does not detect any further input before the first countdown period is complete, the processor 106 is configured to cause the plurality of LEDs 107 to stop emitting light. If the sensor 105 detects a second (or subsequent) input during the first cycle of the first pattern or before the first countdown period is complete, the processor 106 is configured to cause the plurality of LEDs 107 to emit a second (or subsequent) color in a second pattern. The second pattern may be the same or different than the pattern for the first color. The processor 106 then begins the first countdown period again, and the process is repeated according to a third (or other subsequent) color in a third (or other subsequent) pattern until the second countdown period is completed.

If the sensor 105 does not detect any input before the first countdown period is complete, the processor 106 is configured to cause the plurality of LEDs 107 to turn off. When the second countdown period completes, the processor 106 is configured to control the plurality of LEDs 107 to emit all of the colors of light output in a final pattern. In one example, the final pattern includes flashes of the first color, second color, third color, etc. in quick succession. In some embodiments, the second countdown period may not begin until an input is detected during the first countdown period. Depending on the embodiment, the operation mode may not rely on a second countdown mode and instead may end (e.g., by emitting light according to the final pattern) if a predetermined period (e.g., 30 seconds or one minute) of time elapses without the ball detecting an input. In other embodiments, operation may be ended upon satisfying an input condition, such as the ball detecting a double or triple tap.

The first color, second color, third color, etc., of light output by the plurality of LEDs 107 throughout the first operation mode may be random in color (e.g., green, red, blue, yellow, etc.) or appear in a predefined order of colors by the processor 106. After the final pattern is complete, the processor 106 is configured to cause the plurality of LEDs 107 to stop emitting light.

First Example Game Style of the First Example Operation Mode

The first operation mode may be utilized by the plurality of players 200*a*, 200*b*, 200*c*. 200*d* in a first game style, described herein. The plurality of players 200*a*, 200*b*, 200*c*, 200*d* sit or stand close in a circle. Each of the plurality of players 200*a*, 200*b*, 200*c*, 200*d* wears a wristband 300*a*, 300*b*, 300*c*, 300*d*. Each wristband 300*a*, 300*b*, 300*c*, 300*d* corresponds to a different color of light output by the plurality of LEDs 107 within the ball 100. The different colors of light output by the plurality of LEDs 107 may be, for example, green, red, blue, or yellow. A first player 200*a* wearing a first wristband 300*a* begins by holding the ball 100. The first player 200*a* taps or bounces the ball 100 a first time, corresponding to the first input. Accordingly, the plurality of LEDs 107 emits light of a first color in a first LED light pattern. Either during the first cycle of the first LED light pattern or within a first predetermined time period after the first cycle of the first LED light pattern, the first player 200*a* taps or bounces the ball 100 a second time, corresponding to the second input, to initiate a gameplay sequence.

A second predetermined time period begins that lasts a length of the gameplay sequence. If the first player 200*a* does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit a second color in a second LED light pattern. A third predetermined time period begins. The ball 100 is passed to a second player 200*b* wearing the wristband 300*b* corresponding to the second color. If the second player 200*b* does not tap or bounce the ball 100 a third time during the first cycle of the second LED light pattern or during the third predetermined time period, the plurality of LEDs turn off.

The second player 200*b* then taps or bounces the ball 100 a third time and the plurality of LEDs 107 emits a third color in the second LED light pattern. The ball 100 is passed to a third player 200*c* wearing the wristband 300*c* corresponding to the third color. This tapping or bouncing and passing pattern is repeated until the second predetermined time period is complete. Once the second predetermined time period is complete, the plurality of LEDs 107 cycles through all of its colors of light output (e.g., first color, second color, third color, etc.) in a final pattern and the gameplay sequence is completed. The gameplay sequence may be repeated until a final score is reached and a winner is declared.

Second Example Game Style of the First Example Operation Mode

The first operation mode may additionally or alternatively be utilized by the plurality of players 200*a*, 200*b*, 200*c*, 200*d* in a second game style, described herein. The wristbands 300*a*, 300*b*, 300*c*, 300*d* are not necessarily used in the second game style of the first operation mode. The plurality of players 200*a*, 200*b*, 200*c*, 200*d* sit in a circle. A first player 200*a* begins by holding the ball 100. The first player 200*a* taps or bounces the ball 100 a first time and a first color in a first LED light pattern is emitted by the plurality of LEDs 107. Either during the first cycle of the first LED light pattern or within a first predetermined time period after the first cycle of the first LED light pattern, the first player 200*a* taps or bounces the ball 100 a second time to initiate the gameplay sequence. A second predetermined time period begins that lasts the length of the gameplay sequence. If the first player 200*a* does not tap or bounce the ball 100 a second time during the first cycle of the first LED light pattern or within the first predetermined time period after the first cycle of the first LED light pattern, the plurality of LEDs 107 turn off.

After the second time tapping or bouncing the ball 100 as discussed above, the plurality of LEDs 107 emit a second color in a second LED light pattern. A third predetermined time period begins. The ball 100 is passed around the circle (e.g., counter-clockwise), each subsequent player 200*a*, 200*b*, 200*c*, 200*d* tapping or bouncing the ball to initiate a new light pattern and new predetermined time period. This pattern is repeated until the second predetermined time period is complete. Once the second predetermined time period is complete, the plurality of LEDs 107 cycles through all of its colors of light output (e.g., first color, second color, third color, etc.) in a final pattern and the player 200*a*, 200*b*, 200*c*, 200*d* holding the ball 100 during this time is "it." The gameplay sequence may be repeated until a final score is reached and a winner is declared.

Third Example Game Style of the First Example Operation Mode

The first operation mode may also additionally or alternatively be utilized by the plurality of players 200*a*, 200*b*, 200*c*. 200*d* in a third game style, described herein. One wristband 300*a*, 300*b*, 300*c*, 300*d* is placed in each quadrant of a square grid having four quadrants, where each wristband 300*a*, 300*b*, 300*c*, 300*d* corresponds to a different color that may be emitted by the plurality of LEDs 107. The different colors that may be emitted by the plurality of LEDs 107 may be, for example, green, red, blue, or yellow. Each of the plurality of players 200*a*, 200*b*, 200*c*, 200*d* stands in a different quadrant of the square grid. A first player 200*a* wearing a first wristband 300*a* begins by holding the ball 100. The first player 200*a* taps or bounces the ball 100 a first time and a first color in a first LED light pattern is emitted. Either during the first cycle of the first LED light pattern or within a first predetermined time period after the first cycle of the first LED light pattern, the first player 200*a* taps or bounces the ball 100 a second time to initiate a gameplay sequence.

A second predetermined time period begins that lasts a length of the gameplay sequence. If the first player 200*a* does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit a second color in a second LED light pattern. A third predetermined time period then begins. If the second color matches the color of the wristband 300*a*, 300*b*, 300*c*, 300*d* in the quadrant that the first player 200*a* is in, the first player 200*a* taps or bounces the ball 100 again until a different, third color appears. The first player 200*a* then bounces the ball 100 to a second player 200*b* standing in a quadrant with the wristband 300*a*, 300*b*, 300*c*. 300*d* that matches the third color.

Upon the second player 200*b* catching the ball 100, the ball 100 emits a fourth color. The second player 200*b* then bounces the ball 100 to a third player 200*c* standing in a quadrant with the wristband 300*a*, 300*b*, 300*c*, 300*d* that matches the fourth color. Once the second predetermined time period is complete, the plurality of LEDs 107 cycles through all of its colors of light output (e.g., first color, second color, third color, etc.) in a final pattern and the gameplay sequence is completed. The gameplay sequence may be repeated until a final score is reached and a winner is declared.

Second Example Operation Mode

A second operation mode may be conducted according to the process illustrated in FIG. 5. As seen in FIG. 5, first the sensor 105 of the ball 100 detects an initial input from one of the players, such as an externally applied force (e.g., a tap or bounce). The initial input triggers the processor 106 to control the plurality of LEDs 107 to emit a first pattern of light in a first color. As with the first example operation mode, the first pattern of light may be three short flashes in quick succession followed by a three second pause, three long flashes each separated by one second, a series of flashes every other second for five seconds, a solid light for five or ten seconds, or the like, depending on the embodiment. The time periods associated with each pattern may be of any length, and may be pre-determined or random.

After a first cycle of the first pattern is complete, the processor 106 begins a first countdown period. The first countdown period is a predetermined period of time, for example, a multiple of 10 seconds, such as 30 seconds, 60 seconds, or 90 seconds. If the sensor 105 does not detect any further input before the first countdown period is complete, the processor 106 is configured to cause the plurality of LEDs 107 to stop emitting light. If the sensor 105 detects a second input during the first cycle of the first pattern or before the first countdown period is complete, the processor 106 is configured to cause the plurality of LEDs 107 to emit a plurality of colors in a second pattern of light for a second countdown period. The second pattern may be the same or different than the first pattern.

When the second countdown period is complete, the processor 106 is configured to cause the plurality of LEDs 107 to emit a second color in a third pattern for a third countdown period. The third pattern may be the same or different than the first and second patterns. When the third countdown period is complete, the processor 106 is configured to cause the plurality of LEDs 107 to stop emitting light. The first color, second color, plurality of colors, etc., of light output by the plurality of LEDs 107 throughout the second operation mode may be random in color (e.g., green, red, yellow blue) or appear in a predefined order of colors by the processor 106. The first, second, and third countdown periods may or may not be the same length of time.

First Example Game Style of the Second Example Operation Mode

The second operation mode may be utilized by the plurality of players 200*a*, 200*b*, 200*c*, 200*d* in a first style, described herein. The plurality of players 200*a*, 200*b*, 200*c*, 200*d* sit around a table or on the ground in a circle and place the wristbands 300*a*, 300*b*, 300*c*, 300*d* in the center of the table or circle. Each wristband 300*a*, 300*b*, 300*c*, 300*d* corresponds to a different color that may be emitted by the plurality of LEDs 107. The plurality of LEDs 107 may be configured to emit any color including, for example, green, red, blue, or yellow. The first player 200*a* taps or bounces the ball 100 a first time and a first color in a first LED light pattern is emitted by the plurality of LEDs 107. Either during the first cycle of the first LED light pattern or within a first predetermined time period after the first cycle of the first LED light pattern, the first player 200*a* taps or bounces the ball 100 a second time to initiate a gameplay sequence.

If the first player 200*a* does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit a plurality of colors (e.g., red, blue, green, and yellow) in a second pattern for a second countdown period. The first player 200*a* places the ball 100 down on a surface (e.g., the ground or a table).

When the second countdown period is complete, the plurality of LEDs 107 emit a second color in a third pattern for a third countdown period. The plurality of players 200*a*, 200*b*, 200*c*, 200*d* race to grab the wristband 300*a*. 300*b*, 300*c*. 300*d* corresponding to the second color. The player 200*a*, 200*b*, 200*c*, 200*d* who grabs the correct wristband 300*a*, 300*b*, 300*c*, 300*d* first scores a point. The second predetermined time period completes and the plurality of LEDs 107 turn off. The first color, second color, plurality of colors, etc., may or may not be the same color. The first, second, and third countdown periods may or may not be the same length of time. All the wristbands 300*a*, 300*b*, 300*c*, 300*d* are then returned to the center of the table or circle. The above gameplay sequence may be repeated until a final score is reached and a winner is declared.

Second Example Game Style of the Second Example Operation Mode

The second operation mode may also additionally or alternatively be utilized by the plurality of players 200*a*, 200*b*, 200*c*, 200*d* in a second style, described herein. All but one of the plurality of players 200*a*, 200*b*, 200*c*, 200*d* wears a wristband 300*a*, 300*b*, 300*c*, 300*d*. Each wristband 300*a*, 300*b*, 300*c*, 300*d* corresponds to a different color that may be emitted by the plurality of LEDs 107. The plurality of LEDs 107 may be configured to emit any color including. for example, green, red, blue, or yellow. The plurality of players 200*a*, 200*b*, 200*c*, 200*d* wearing the wristbands 300*a*, 300*b*, 300*c*, 300*d* stand in a line on an opposite side of the player 200*a*, 200*b*, 200*c*, 200*d* not wearing a wristband 300*a*, 300*b*, 300*c*, 300*d* relative to a predetermined location. The player 200*a*, 200*b*, 200*c*, 200*d* not wearing a wristband 300*a*, 300*b*, 300*c*, 300*d* taps or bounces the ball 100 a first time and a first color in a first LED light pattern is emitted by the plurality of LEDs 107.

Either during the first cycle of the first LED light pattern or within a first predetermined time period after the first cycle of the first LED light pattern, the player 200*a*, 200*b*, 200*c*, 200*d* not wearing a wristband 300*a*, 300*b*, 300*c*, 300*d* taps or bounces the ball 100 a second time to initiate a gameplay sequence. If the player 200*a*, 200*b*, 200*c*, 200*d* not wearing the wristband 300*a*, 300*b*, 300*c*, 300*d* does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit a plurality of colors (e.g., red, blue, green, and yellow), in a second pattern for a second countdown period.

When the second countdown period is complete, the plurality of LEDs 107 emit a second color in a third pattern for a third countdown period. The player 200*a*, 200*b*, 200*c*, 200*d* wearing the wristband 300*a*, 300*b*, 300*c*, 300*d* corresponding to the second color races past the player 200*a*, 200*b*, 200*c*, 200*d* not wearing the wristband 300*a*, 300*b*, 300*c*, 300*d* to the predetermined location. The player 200*a*, 200*b*, 200*c*, 200*d* not wearing a wristband 300*a*, 300*b*, 300*c*, 300*d* races to tag the player 200*a*, 200*b*, 200*c*. 200*d* wearing the wristband 300*a*, 300*b*, 300*c*, 300*d* corresponding to the second color. If the player 200*a*, 200*b*, 200*c*, 200*d* wearing the corresponding wristband 300*a*, 300*b*, 300*c*, 300*d* gets tagged, he or she surrenders his or her wristband 300*a*, 300*b*, 300*c*. 300*d* to the player 200*a*, 200*b*, 200*c*, 200*d* not wearing a wristband 300*a*, 300*b*, 300*c*, 300*d*. If the player 200*a*, 200*b*, 200*c*, 200*d* wearing the corresponding wristband 300*a*, 300*b*, 300*c*, 300*d* does not get tagged, he or she returns to his or her original position.

When the third countdown period is complete, the plurality of LEDs 107 turn off. The first color, second color, plurality of colors, etc., may or may not be the same color. The first, second, and third countdown periods may or may not be the same length of time. The above gameplay sequence may be repeated until a final score is reached and a winner is declared.

Third Example Game Style of the Second Example Operation Mode

The second operation mode may also additionally or alternatively be utilized by the plurality of players 200*a*, 200*b*, 200*c*, 200*d* in a third style, described herein. Each of the plurality of players 200*a*, 200*b*, 200*c*, 200*d* wear a wristband 300*a*, 300*b*, 300*c*, 300*d*. Each wristband 300*a*, 300*b*, 300*c*, 300*d* corresponds to a different color that may be emitted by the plurality of LEDs 107. The plurality of LEDs 107 may be configured to emit any color including, for example, green, red, blue, or yellow. A first player 200*a* taps or bounces the ball 100 a first time and a first color in a first LED light pattern is emitted by the plurality of LEDs 107.

Either during the first cycle of the first LED light pattern or within a first predetermined time period after the first cycle of the first LED light pattern, the first player 200*a* taps or bounces the ball 100 a second time to initiate a gameplay sequence. If the first player 200*a* does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit a plurality of colors (e.g., red, blue, green, and yellow) in a second pattern for a second countdown period. The first player 200*a* sets the ball 100 down on a surface (e.g., the ground or a table) where each of the plurality of players 200*a-d* can see it.

When the second countdown period is complete, the plurality of LEDs 107 emit a second color in a third pattern for a third countdown period. A player 200*a*, 200*b*, 200*c*, 200*d* wearing the wristband 300*a*, 300*b*, 300*c*, 300*d* corresponding in color to the second color races to grab the ball 100 while the remaining players 200*a*, 200*b*, 200*c*, 200*d* run away from the ball 100. When the player 200*a*, 200*b*, 200*c*, 200*d* wearing the wristband 300*a*, 300*b*, 300*c*, 300*d* corresponding in color to the second color grabs the ball 100, he or she yells "stop" and the remaining players 200*a*. 200*b*, 200*c*, 200*d* stop in their positions. The player 200*a*, 200*b*, 200*c*, 200*d* wearing the wristband 300*a*, 300*b*, 300*c*, 300*d* corresponding in color to the second color takes a predetermined number of steps (e.g., five) toward a closest player 200*a*, 200*b*, 200*c*, 200*d* to attempt to tag him or her. If the closest player 200*a*, 200*b*, 200*c*, 200*d* is tagged, he or she gives his or her wristband 300*a*, 300*b*, 300*c*. 300*d* to the player 200*a*, 200*b*, 200*c*, 200*d* wearing the wristband 300*a*, 300*b*, 300*c*, 300*d* corresponding in color to the second color.

When the third countdown period is complete, the plurality of LEDs 107 turn off. The first color, second color, plurality of colors, etc., may or may not be the same color. The first, second, and third countdown periods may or may not be the same length of time. The above gameplay sequence may be repeated until a final score is reached and a winner is declared.

Third Example Operation Mode

A third operation mode may be conducted according to the process illustrated in FIG. 6. As seen in FIG. 6, the sensor 105 of the ball 100 first detects an initial input from one of the players, such as an externally applied force (e.g., a tap or bounce). The initial input triggers the processor 106 to control the plurality of LEDs 107 to emit a first pattern of light in a first color. As with the other example operation modes, the first pattern of light may be three short flashes in quick succession followed by a three second pause, three long flashes each separated by one second, a series of flashes every other second for five seconds, a solid light for five or ten seconds, or the like, depending on the embodiment. The time periods associated with each pattern may be of any length, and may be pre-determined or random.

After a first cycle of the first pattern is complete, the processor 106 begins a first countdown period and a second countdown period, the second countdown period being longer than the first countdown period. The first countdown period is a predetermined period of time that may be, for example, a multiple of 10 seconds, such as 30 seconds, 60 seconds, or 90 seconds in length. The second countdown period may be, for example, a random period of time generated by the processor 106, or a predetermined period of time (e.g., two minutes, five minutes, or the like). Depending on the embodiment, the operation mode may not rely on a second countdown mode and instead may end (e.g., by emitting light according to the final pattern) if a predetermined period (e.g., 30 seconds or one minute) of time elapses without the ball detecting an input. In other embodiments, operation may be ended upon satisfying an input condition, such as the ball detecting a double or triple tap.

If the sensor 105 does not detect any further input before the first countdown period is complete, the processor 106 is configured to cause the plurality of LEDs 107 to stop emitting light. If the sensor 105 detects a second (or subsequent) input during the first cycle of the first pattern or before the first countdown period is complete, the processor 106 is configured to cause the plurality of LEDs 107 to emit either a second color or a third color at random. The second color and the third color may be, for example, either red or green. In some embodiments, the second countdown period may not begin until an input is detected during the first countdown period.

Each subsequent input detected by the sensor 105 thereafter results in the processor 106 controlling the plurality of LEDs 107 to emit either the second color or the third color at random. When the second countdown period ends, processor 106 is configured to cause the plurality of LEDs 107 to turn off.

First Example Game Style of the Third Example Operation Mode

The third operation mode may be utilized by the plurality of players 200*a*, 200*b*, 200*c*. 200*d* in a first style, described herein. The plurality of players 200*a*, 200*b*, 200*c*, 200*d* sit in a large circle with one player 200*a*, 200*b*, 200*c*, 200*d* in the center of the circle. The wristbands 300*a*, 300*b*, 300*c*, 300*d* are not necessarily used in this game style. The player 200*a*, 200*b*, 200*c*, 200*d* in the center of the circle taps or bounces the ball 100 a first time and a first color in a first LED light pattern is emitted. Either during the first cycle of the first LED light pattern or within a first predetermined time period after the first cycle of the first LED light pattern, the player 200*a*, 200*b*, 200*c*, 200*d* in the center of the circle taps or bounces the ball 100 a second time to initiate a gameplay sequence. A second predetermined time period begins that lasts a length of the gameplay sequence. If the player 200*a*. 200*b*, 200*c*, 200*d* in the center of the circle does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit either a second color or a third color at random. The second color and the third color may be, for example, either red or green. If the second color (e.g., red) is emitted. the player 200*a*, 200*b*, 200*c*, 200*d* in the center of the circle tells everyone to stop. If the third color (e.g., green) is emitted, the player 200*a*, 200*b*, 200*c*, 200*d* in the center of the circle tells everyone to take one step towards him or her. This is repeated by tapping or bouncing the ball 100 until the second predetermined time period expires, thus turning off the plurality of LEDs.

Second Example Game Style of the Third Example Operation Mode

The third operation mode may additionally or alternatively be utilized by the plurality of players 200*a*, 200*b*, 200*c*, 200*d* in a second style, described herein. The plurality of players 200*a*, 200*b*, 200*c*, 200*d* sit in a large circle. The wristbands 300*a*, 300*b*, 300*c*, 300*d* are not necessarily used in this game style. A first player 200*a* taps or bounces the ball 100 a first time and a first color in a first LED light pattern is emitted. Either during the first cycle of the first LED light pattern or within a first predetermined time period after the first cycle of the first LED light pattern, the first player 200*a* taps or bounces the ball 100 a second time to initiate a gameplay sequence. A second predetermined time period begins that lasts a length of the gameplay sequence. If the first player 200*a* does not tap or bounce the ball 100 a second time during the first cycle of the first LED light pattern or within the first predetermined time period after the first cycle of the first LED light pattern, the plurality of LEDs 107 turn off. After the second time tapping or bouncing the ball 100 as discussed above, the plurality of LEDs 107 emit either a second color or a third color at random. If the second color is emitted, the first player 200*a* completes a first action (e.g., telling a "truth"). If the third color is emitted, the first player 200*a* completes a second action (e.g., performing a "dare").

The ball 100 is then passed to another player 200*a*, 200*b*, 200*c*, 200*d* and the action of tapping or bouncing the ball 100 is repeated. If the second color is emitted, the player 200*a*, 200*b*, 200*c*, 200*d* holding the ball 100 completes the first action (e.g., telling a "truth"). If the third color is emitted, the player 200*a*, 200*b*, 200*c*, 200*d* holding the ball 100 completes the second action (e.g., performing a "dare"). This is repeated until the second predetermined time period expires, thus turning off the plurality of LEDs.

Third Example Game Style of the Third Example Operation Mode

The third operation mode may also additionally or alternatively be utilized by the plurality of players 200*a*, 200*b*, 200*c*, 200*d* in a third style, described herein. Each of the plurality of players 200*a*, 200*b*, 200*c*, 200*d* selects one wristband 300*a*, 300*b*, 300*c*, 300*d* as their own. Each of the plurality of players 200*a*, 200*b*, 200*c*, 200*d* place their wristband 300*a*, 300*b*, 300*c*, 300*d* in a square of a hopscotch path. A first player 200*a* taps or bounces the ball 100 a first time and a first color in a first LED light pattern is emitted. Either during the first cycle of the first LED light pattern or within a first predetermined time period after the first cycle of the first LED light pattern, the first player 200*a* taps or bounces the ball 100 a second time to initiate a gameplay sequence. A second predetermined time period begins that lasts a length of the gameplay sequence. If the first player 200*a* does not tap or bounce the ball 100 a second time during the first cycle of the first LED light pattern or within the first predetermined time period after the first cycle of the first LED light pattern, the plurality of LEDs 107 turn off.

After the second time tapping or bouncing the ball 100 as discussed above, the plurality of LEDs 107 emit either a second color or a third color at random. If the second color is emitted by the plurality of LEDs 107, the first player 200*a* may continue on the hopscotch path, avoiding the square with their wristband 300*a* in it. If the third color is emitted by the plurality of LEDs 107, the first player 200*a* may tap or bounce the ball 100 two additional times to try to get the second color. If the first player 200*a* does not see the second color emitted by the plurality of LEDs 107 after three taps or bounces, he or she may not continue along the hopscotch path. The ball 100 is rotated through the plurality of players 200*a*, 200*b*, 200*c*, 200*d*, each repeating this process until the second predetermined time period ends.

While various features are presented above, it should be understood that the features may be used singly or in any combination thereof. Further, it should be understood that variations and modifications may occur to those skilled in the art to which the claimed examples pertain.

What is claimed is:

1. A system comprising:
a ball comprising:
a shell through which light can pass;
a sensor;
a processor;
a memory configured to store rules for operation of the processor; and
a plurality of light emitting diodes (LEDs) configured to emit light of a plurality of different colors; and
a plurality of wristbands, each of the plurality of wristbands being a different color and corresponding to one of the plurality of colors of light emitted from the plurality of LEDs,
wherein the processor is configured to:
detect an initial input caused by bouncing or tapping the ball based on an output of the sensor;
after detecting the initial input, begin a first countdown period and cause the plurality of LEDs to emit light of a first color in a first pattern;
detect a second input caused by bouncing or tapping the ball based on the output of the sensor prior to the first countdown period expiring; and
after detecting the second input, begin a second countdown period and cause the plurality of LEDs to emit light of a second color in a second pattern,
wherein the first color and the second color are different, or the first pattern or the second pattern are different, and
wherein the second countdown period is longer than the first countdown period.

2. The system of claim 1, wherein the shell is an elastomeric material.

3. The system of claim 1, wherein the sensor is a gyrometer, accelerometer, or force sensor.

4. The system of claim 1, wherein the processor is configured to cause the plurality of LEDs to stop emitting light when no input is detected within the first countdown period.

5. A system comprising:
a ball comprising:
a shell through which light can pass;
a sensor;
a processor;
a memory configured to store rules for operation of the processor; and
a plurality of light emitting diodes (LEDs) configured to emit light of a plurality of different colors; and
a plurality of wristbands, each of the plurality of wristbands being a different color and corresponding to one of the plurality of colors of light emitted from the plurality of LEDs,
wherein the processor is configured to:
detect an initial input caused by bouncing or tapping the ball based on an output of the sensor;
after detecting the initial input, cause the plurality of LEDs to emit light of a first color for one cycle of a first pattern;
after detecting the initial input, begin a first countdown period and a second countdown period; and
until expiration of the first countdown period or the second countdown period:
detect a subsequent input caused by bouncing or tapping the ball based on the output of the sensor;
after detecting the subsequent input, cause the plurality of LEDs to emit light of a subsequent color; and
after detecting the subsequent input, reset the first countdown period,
wherein the second countdown period is longer than the first countdown period.

6. A system comprising:
a ball comprising:
a shell through which light can pass;
a sensor;
a processor;
a memory configured to store rules for operation of the processor; and
a plurality of light emitting diodes (LEDs) configured to emit light of a plurality of different colors; and
a plurality of wristbands, each of the plurality of wristbands being a different color and corresponding to one of the plurality of colors of light emitted from the plurality of LEDs,
wherein the processor is configured to:
detect an initial input caused by bouncing or tapping the ball based on an output of the sensor;
after detecting the initial input, cause the plurality of LEDs to emit light of a first color for one cycle of a first pattern;
after detecting the initial input, begin a first countdown period;
detect a second input caused by bouncing or tapping the ball based on the output of the sensor prior to the first countdown period expiring; and
after detecting the second input:
cause the plurality of LEDs to emit light of a second color for a second countdown period; and after the second countdown period, cause the plurality of LEDs to emit light of a third color for a third countdown period, wherein at least one of the first color, the second color, and the third color is different than the other colors.

7. A system comprising:

a ball comprising:

a shell through which light can pass;

a sensor;

a processor;

a memory configured to store rules for operation of the processor; and a plurality of light emitting diodes (LEDs) configured to emit light of a plurality of different colors; and a plurality of wristbands, each of the plurality of wristbands being a different color and corresponding to one of the plurality of colors of light emitted from the plurality of LEDs, wherein the processor is configured to:

detect an initial input caused by bouncing or tapping the ball based on an output of the sensor;

after detecting the initial input, cause the plurality of LEDs to emit light of a first color for one cycle of a first pattern;

detect at least one subsequent input caused by bouncing or tapping the ball based on the output of the sensor; and after detecting each subsequent input, cause the plurality of LEDs to randomly emit light of a second color or a third color, wherein the second color and the third color are different than each other and different than the first color.

8. The system of claim 7, wherein the second color is red and the third color is green.

9. The system of claim 5, wherein the shell is an elastomeric material.

10. The system of claim 5, wherein the sensor is a gyrometer, accelerometer, or force sensor.

11. The system of claim 6, wherein the shell is an elastomeric material.

12. The system of claim 6, wherein the sensor is a gyrometer, accelerometer, or force sensor.

13. The system of claim 7, wherein the shell is an elastomeric material.

14. The system of claim 7, wherein the sensor is a gyrometer, accelerometer, or force sensor.

* * * * *